US007878817B2

(12) United States Patent
Lin et al.

(10) Patent No.: US 7,878,817 B2
(45) Date of Patent: Feb. 1, 2011

(54) ELECTRICAL CONTACT WITH X-Y OFFSETS

(75) Inventors: Chun-Fu Lin, Tu-Cheng (TW); Hsiu-Yuan Hsu, Tu-Cheng (TW); Jia-Hau Liu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/464,032

(22) Filed: May 11, 2009

(65) Prior Publication Data

US 2009/0280689 A1 Nov. 12, 2009

(30) Foreign Application Priority Data

May 12, 2008 (TW) ..... 97117367 A

(51) Int. Cl.
*H01R 12/00* (2006.01)

(52) U.S. Cl. ..... 439/66

(58) Field of Classification Search ..... 439/66, 439/81

See application file for complete search history.

(56) References Cited

U.S. PATENT DOCUMENTS 4,553,192 A * 11/1985 Babuka et al. ..... 361/743
5,653,598 A * 8/1997 Grabbe ..... 439/66
6,186,797 B1 2/2001 Wang et al.
6,488,513 B1 * 12/2002 Neidich et al. ..... 439/66
6,652,329 B1 11/2003 Howell et al.
6,843,659 B2 1/2005 Liao et al.
6,887,114 B2 5/2005 Liao
6,957,964 B2 * 10/2005 Chiang ..... 439/66
6,976,888 B2 * 12/2005 Shirai et al. ..... 439/862
7,467,949 B2 * 12/2008 Liao ..... 439/66

FOREIGN PATENT DOCUMENTS

CN 2745252 12/2005

* cited by examiner

*Primary Examiner*—Neil Abrams
(74) *Attorney, Agent, or Firm*—Andrew C. Cheng; Wei Te Chung; Ming Chieh Chang

(57) ABSTRACT

An electrical contact (1) includes an upper extending portion (11), a lower extending portion (12) and a bridge portion (13). The upper extending portion includes a first contact portion (111), a C-shaped connecting portion (1121) connecting with the first contact portion and a tail portion (1122) extending downwardly from a free end of the C-shaped connecting portion. The lower extending portion includes a second contact portion (121), a vertical portion (1222) and an inclined portion (1221) connecting with the second contact portion and the vertical portion. The bridge portion is integrally formed between the tail portion and the vertical portion. One of the upper extending portion and the lower extending portion is rotated around the bridge portion to form an angular relationship between the planes of the upper and lower portions.

16 Claims, 6 Drawing Sheets

ELECTRICAL CONTACT WITH X-Y OFFSETS

BACKGROUND OF THE INVENTION

1. Field of the Invention

The present invention relates generally to electrical contacts, and more particularly to an electrical contact with X-Y offsets for connecting a central processing unit (CPU) with a printed circuit board (PCB).

2. Description of Related Arts

An electrical connector connects the CPU with the PCB for transmitting signals therebeween and is used more and more frequently according to popularization of the electric products such as computers. Electrical contacts comprise Pin Grid Array (PGA) contacts, Ball Grid Array (BGA) contacts and Land Grid Array (LGA) contacts, and accordingly, electrical connectors comprising said kinds of contacts are divided into PGA connectors, BGA connectors and LGA connectors.

An LGA contact comprises a first cantilever am with a first contact portion at a free end thereof for connecting with the CPU, a second cantilever arm with a second contact portion at a free end thereof for connecting with the PCB and a connection portion combining the first and second cantilever arms. The contact has a generally C-shaped profile and in detail, the first cantilever arm extends upwardly and forwardly from the upper section of the connection portion and the second cantilever arm extends downwardly and forwardly from the lower section of the connection portion. As a result, the first contact portion and the second contact portion echo each other along a vertical line. Such kind of contact is limited in a useable condition that the CPU and the PCB must be acquired to be in a vertical line. The contact does not suit for the multiplicity of the CPU according to a very fast development of the electrical technology.

An improved electrical contact comprises a center torsion beam, two engagement plates integrally connected to two ends of the center torsion beam and two spring arms extending oppositely from a center section of the torsion beam, with one extending upwardly and forwardly while the other one extending downwardly and backwardly. The contacting portions of the contact respectively abut against the contact pads both of the CPU and the PCB and because the contacting portions are not positioned along a vertical direction, the connected CPU and the connected PCB are located with X-Y offset. Such kind of contact provides a special X-Y offset, though it can provide diversified X-Y offsets by adjusting angles in the housing. The method said above is rather troublesome for the mating housing should be molded again to mate with the engagement plates of the contact.

Hence, an improved electrical contact with adjustable X-Y offsets is desired.

SUMMARY OF THE INVENTION

Accordingly, an object of the present invention is to provide an electrical contact with adjust X-Y offsets to suit for different acquires of different customers.

To achieve the above object, an electrical contact includes an upper extending portion, a lower extending portion and a bridge portion. The upper extending portion includes a first contact portion, a C-shaped connecting portion connecting with the first contact portion and a tail portion extending downwardly from a free end of the C-shaped connecting portion. The lower extending portion includes a second contact portion, a vertical portion and an inclined portion connecting with the second contact portion and the vertical portion. The bridge portion is integrally formed between the tail portion and the vertical portion. One of the upper extending portion and the lower extending portion rotates around the bridge portion.

Other objects, advantages and novel features of the invention will become more apparent from the following detailed description when taken in conjunction with the accompanying drawings.

DETAILED DESCRIPTION OF THE PREFERRED EMBODIMENT

Figure 1:
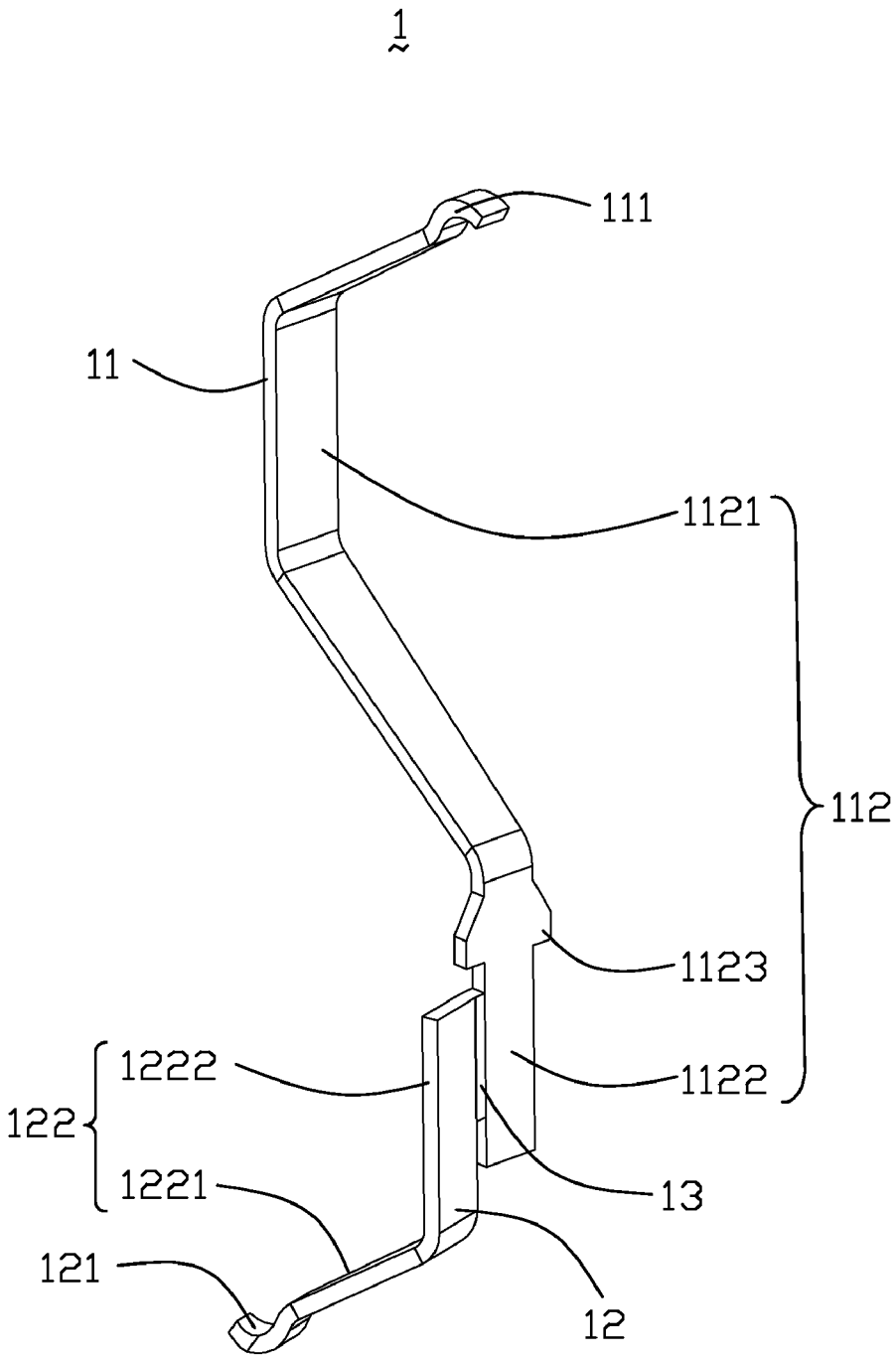
FIG. 1 is a perspective view of an electrical contact according to the present invention.
Figure 2:
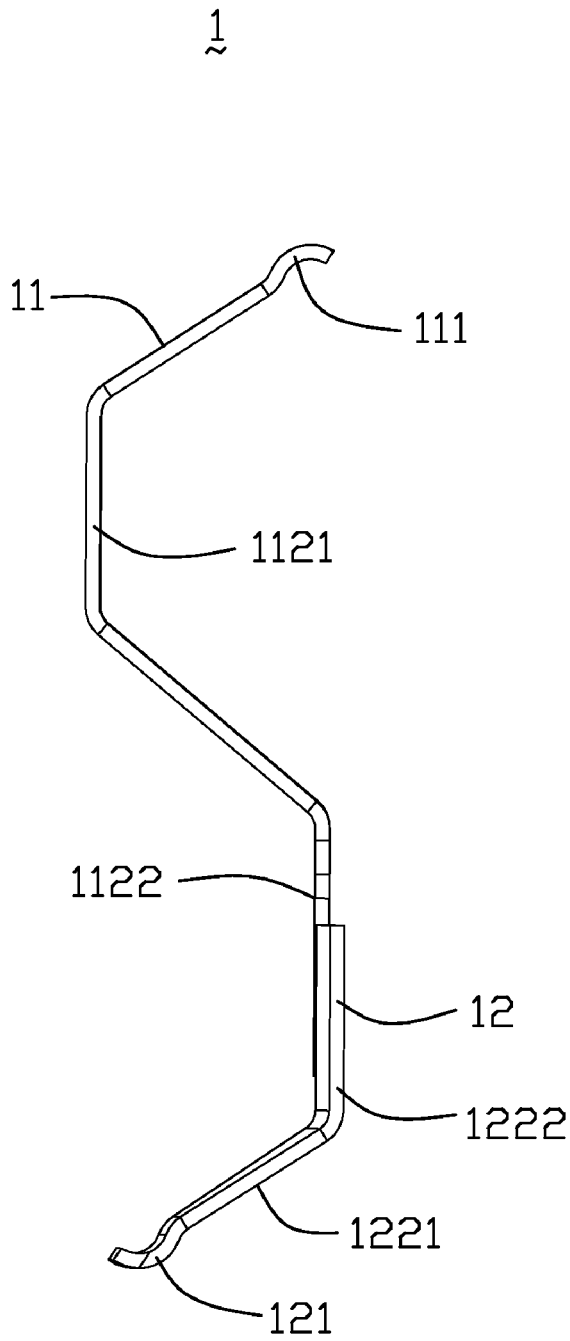
FIG. 2 is a left side view of the electrical contact.
Figure 3:
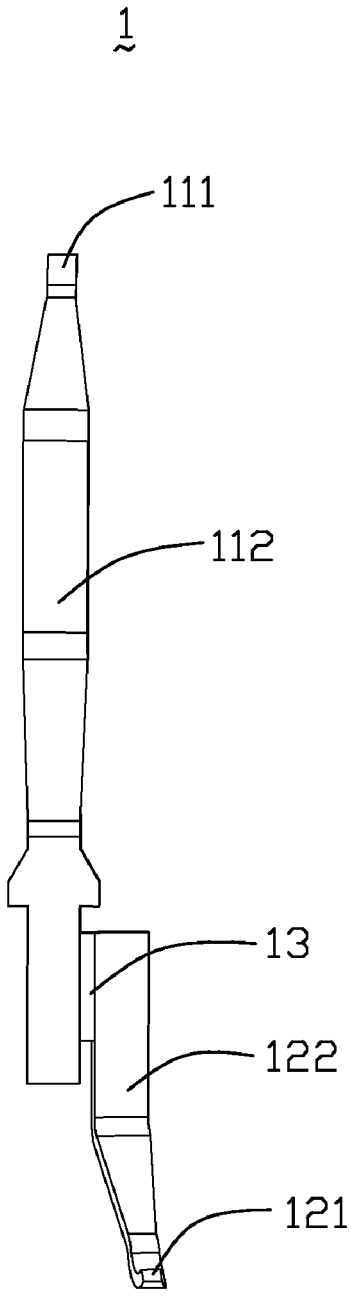
FIG. 3 is a rear elevational view of the electrical contact.
Figure 4:
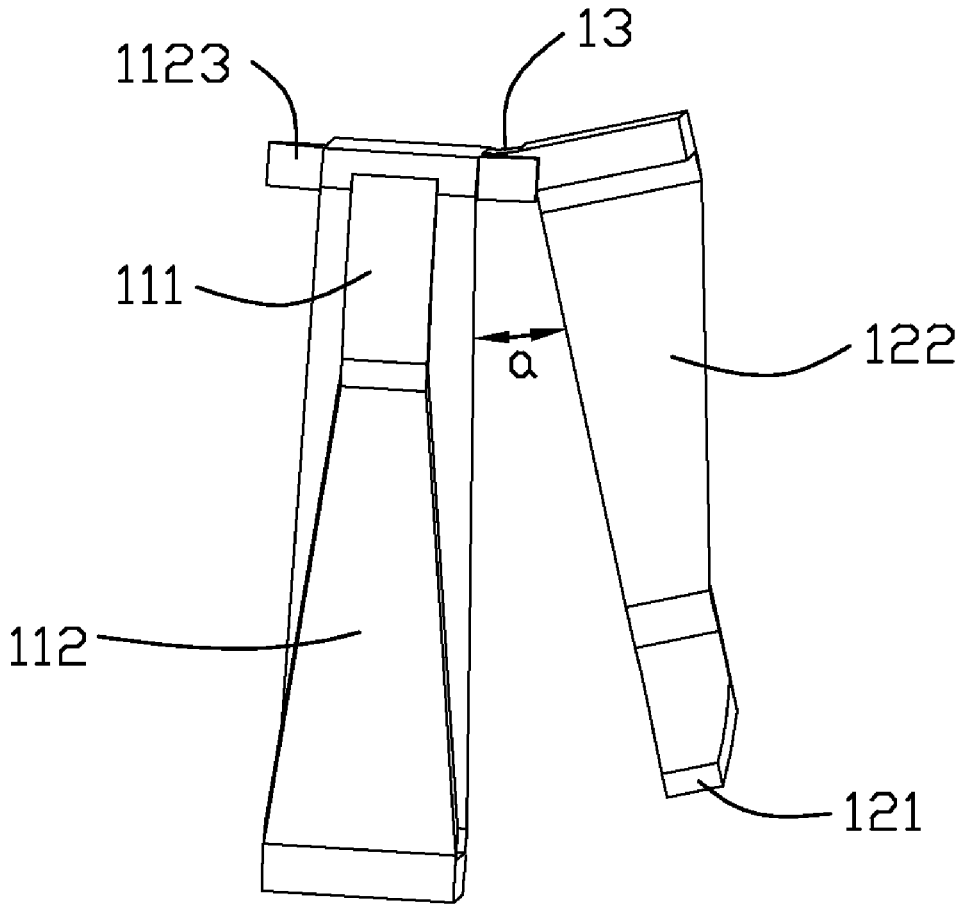
FIG. 4 is a top plan view of the electrical contact.
Figure 5:
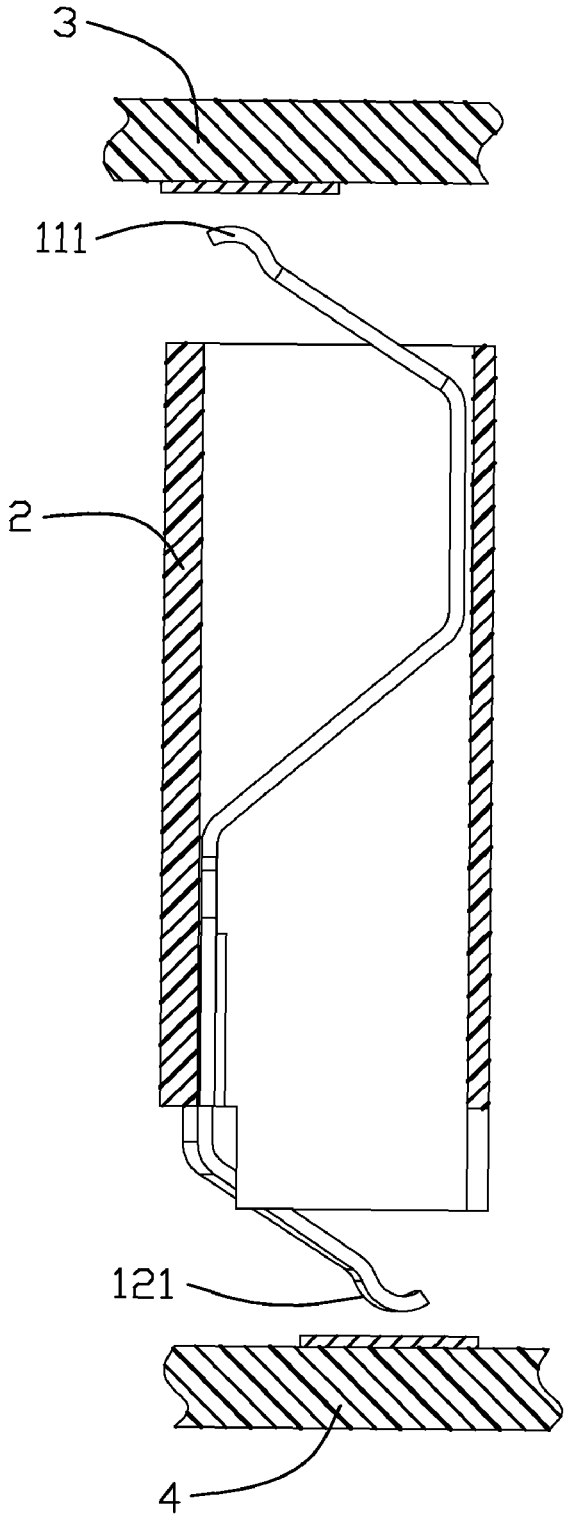
FIGS. 5 and 6 are front elevational views of the contact positioned in a housing.
Figure 6:
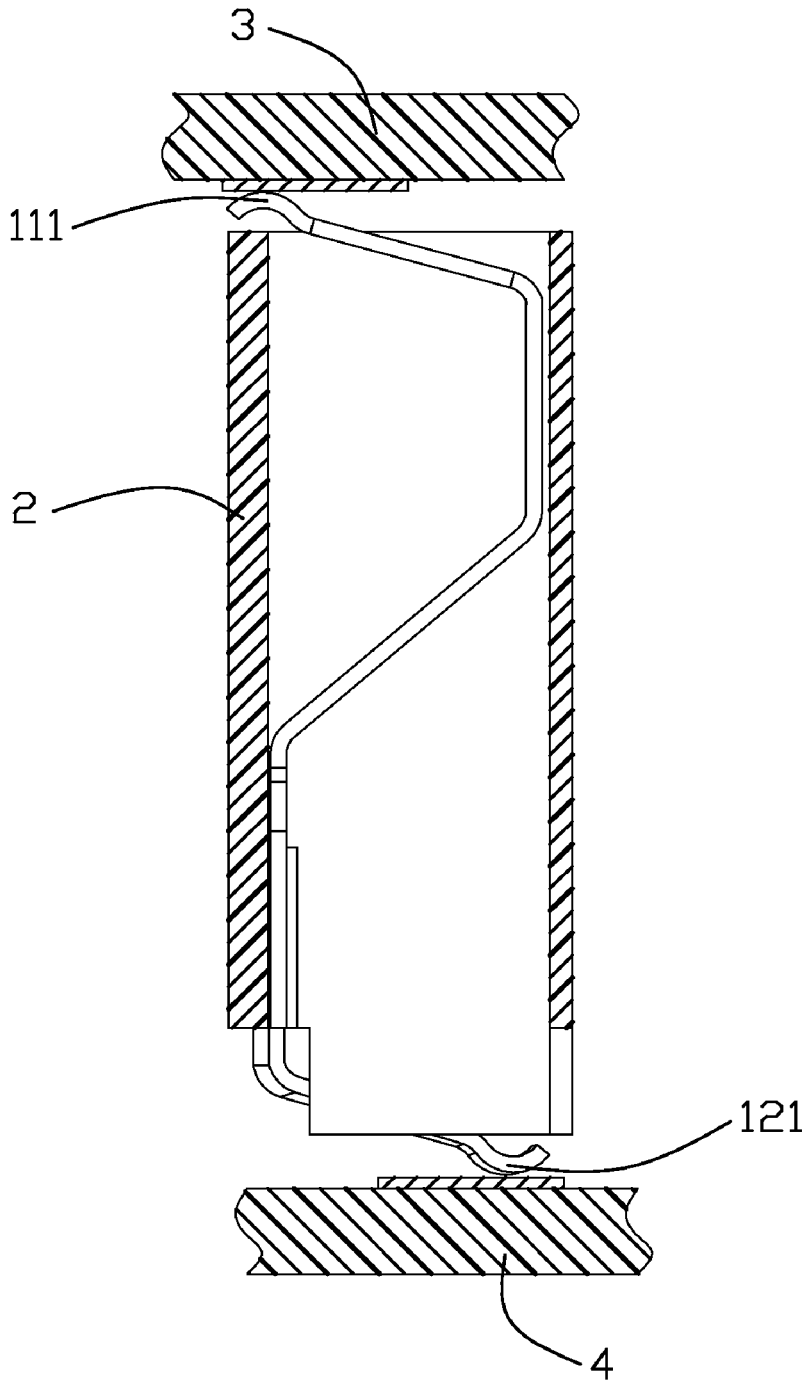

FIGS. 1-4 illustrate an electrical contact 1 in accordance with the present invention, used for connecting a central processing unit (CPU) (not shown) with a printed circuit board (PCB) (not shown) to transmitting signals therebetween. The electrical contact 1 integrally comprises an upper extending portion 11, a lower extending portion 12 and a bridge portion 13 connecting the upper extending portion 11 with the lower extending portion 12. The upper extending portion 11 comprises a first contact portion 111 connecting with the CPU and a first spring arm 112. The first spring arm 112 comprises a C-shaped connecting portion 1121 and a tail portion 1122 extending downwardly from a free end of the C-shaped connecting portion 1121. The tail portion 1122 forms a plurality of fastening portions 1123 for retaining the electrical contact 1 in a housing (not shown). The lower extending portion 12 comprises a second contact portion 121 connecting with the PCB and a second spring arm 122. The second spring arm 122 comprises a vertical portion 1222 and an inclined portion 1221 connecting with the vertical portion 1222 and the second contact portion 121. The tail portion 1122 and the vertical portion 1222 are both connected to the bridge portion 13 to communicate with each other. The first contact portion 111 and the second contact portion 121 are both curved and extend oppositely. In this embodiment, the fastening portions 1123 are formed on the tail portion 1122 of the upper extending portion 11; in an alternative embodiment, a plurality of fastening portions formed on the vertical portion 1222 of the lower extending portion 12 is feasible. In a general view, the electrical contact 1 has an S-shaped configuration.

In fabrication, first, a metal sheet is stricken out by a punch to be an embryo electrical contact 1 with the upper extending portion 11 and the lower extending portion 12 both connected to the bridge portion 13, while the upper extending portion 11 and the lower extending portion 12 extend oppositely. The upper extending portion 11, the lower extending portion 12 and the bridge portion 13 are in a same plane. Secondly, the electrical contact 1 is pressed to be an S-shaped figure with a C-shaped connecting portion 1121 formed on the upper extending portion 11 and an inclined portion 1221 formed on the lower extending portion 12. The inclined portion 1221 extends along a direction opposite to a direction which is defined by an opening of the C-shaped connecting portion 1121. At this time, the tail portion 1122 of the upper extending portion 11 and the vertical portion 1222 of the lower extending portion 12 remain in a same plane. Finally, an angle "a" is formed between the tail portion 1122 and the vertical portion 1222 by bending the bridge portion 13 according to the different arrangements of the CPU and the PCB, so, an adjust X-Y offset is generated on the electrical contact 1 and the electrical contact 1 can be effectively connected to the CPU and the PCB having different arrangements. When the electrical contact 1 is inserted into a housing (not shown), one of the upper extending portion 11 and the lower extending portion 12, which has the fastening portions 1123, is engaged with the housing, while the other one rotates around the bridge portion 13 for providing adjustable X-Y offsets. This invention provides a cost down because of no need to replace the housing.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical contact comprising:

an upper extending portion comprising a first contact portion, a C-shaped connecting portion connecting with the first contact portion and a tail portion extending downwardly from the C-shaped connecting portion;

a lower extending portion comprising a second contact portion, a vertical portion and an inclined portion connecting with the second contact portion and the vertical portion; and a bridge portion integrally formed between the tail portion and the vertical portion; wherein one of the upper extending portion and the lower extending portion is rotated around the bridge portion; and wherein the contact has a generally S-shaped figure.

2. The electrical contact as described in claim 1, wherein the inclined portion extends along a direction opposite to a direction which is defined by an opening of the C-shaped connecting portion.

3. The electrical contact as described in claim 2, wherein the contact portions are curved.

4. The electrical contact as described in claim 3, wherein the first contact portion connects with a CPU.

5. The electrical contact as described in claim 3, wherein the second contact portion connects with a PCB.

6. The electrical contact as described in claim 2, further comprising a plurality of fastening portions formed on the tail portion.

7. The electrical contact as described in claim 2, further comprising a plurality of fastening portions formed on the vertical portion.

8. An electrical connector comprising:

an insulative housing defining at least one passageway;

a contact disposed in the passageway and including:

an upward extending and downward deflectable resilient contact section essentially located in a first vertical plane in a top view;

a downward extending and upward deflectable resilient tail section essentially located in a second vertical plane beside said first plane in said top view;

said upward extending contact section and said downward extending tail section linked to each other via a transverse bridge portion; wherein said upward extending contact section defines an upper engagement end region for engagement with an upper electronic part, and said downward extending tail section defines a lower engagement end region for engagement with the lower electronic art under condition that deflection of said upper engagement end region is spanned in a downward direction and a first transverse direction, and that of said lower engagement end region is spanned in a vertical direction opposite to said downward direction, and a second transverse direction which is not same with or parallel to said first transverse direction.

9. The electrical contact as claimed in claim 8, wherein said bridge portion is located around a lower portion of the upward extending contact section.

10. The electrical contact as claimed in claim 8, wherein said upward extending contact section is further equipped with a retention section around a lower portion thereof.

11. The electrical contact as claimed in claim 10, wherein said bridge portion is lower than said retention section.

12. The electrical connector as claimed in claim 8, wherein said first plane is angled with said second plane.

13. The electrical connector as claimed in claim 8, wherein said first transverse direction is angled with said second transverse direction.

14. The electrical connector as claimed in claim 8, wherein said upward extending contact section extends initially from a first inner wall of the corresponding passageway to a second inner wall of the corresponding passageway opposite to said first inner wall and successively from said second inner wall back to said first inner wall.

15. The electrical connector as claimed in claim 8, wherein the first transverse direction is obtuse to the second transverse direction.

16. An electrical connector comprising:

an insulative housing defining at least one passageway;

a contact disposed in the passageway and including:

an upward extending and downward deflectable resilient contact section essentially located in a first vertical plane in a top view;

a downward extending and upward deflectable resilient tail section essentially located in a second vertical plane beside said first plane in said top view; and said upward extending contact section and said downward extending tail section linked to each other via a transverse bridge portion; wherein said upward extending contact section extends initially from a first inner wall of the corresponding passageway to a second inner wall of the corresponding passageway opposite to said first inner wall and successively from said second inner wall back to said first inner wall.

* * * * *